United States Patent [19]

Girard

[11] Patent Number: 4,875,349

[45] Date of Patent: Oct. 24, 1989

[54] DEVICE FOR LOCKING DOUBLE SLIDING DOORS

[76] Inventor: Mario D. Girard, 2959, Mandeville,, Longueuil, Quebec, Canada, J4L/4G8

[21] Appl. No.: 230,914

[22] Filed: Aug. 11, 1988

[51] Int. Cl.[4] ..... E05B 65/08

[52] U.S. Cl. ..... 70/95; 70/90; 70/DIG. 65; 292/339; 292/DIG. 46

[58] Field of Search ..... 70/14, 57, 89, 90, 95, 70/DIG. 65, DIG. 66; 292/288, 289, 339, 343, DIG. 46

[56] References Cited

U.S. PATENT DOCUMENTS

| | | | |
|---|---|---|---|
| 625,304 | 5/1899 | Kendrick | 292/339 |
| 2,049,860 | 8/1936 | Olson | 70/95 X |
| 2,249,214 | 7/1941 | Kurtzon | 292/DIG. 46 X |
| 3,401,994 | 9/1968 | Diack | 70/95 X |

FOREIGN PATENT DOCUMENTS

| | | | |
|---|---|---|---|
| 855950 | 11/1970 | Canada . | |
| 1156062 | 11/1983 | Canada . | |
| 617965 | 8/1935 | Fed. Rep. of Germany | 70/95 |
| 530650 | 7/1955 | Italy | 70/90 |
| 703557 | 2/1954 | United Kingdom | 70/14 |

*Primary Examiner*—Gary L. Smith
*Assistant Examiner*—Douglas E. Ringel
*Attorney, Agent, or Firm*—Roland L. Morneau

[57] ABSTRACT

A locking device for double sliding doors or windows consisting of at least two separable and superposed plates to be located between the adjacent vertical jambs of the exterior and interior doors. The plates have a shank and two oppositely directed tongues at each end of the shank. The plates are thin enough to be separately introduced edgewise between the adjacent jambs and rotated flatwise one over the other. The space between the tongues is determined to abut against the adjacent jambs. All the plates are fastened together to prevent them from being rotated edgewise and removed from between the jambs.

9 Claims, 3 Drawing Sheets

DEVICE FOR LOCKING DOUBLE SLIDING DOORS

BACKGROUND OF THE INVENTION

1. Field of the Invention

The invention is directed to a device for locking double sliding doors and more particularly to a set of separate superposed plates adapted to stop the doors in their positin.

2. Prior Art

Locking devices for sliding doors or windows are known and essentially consist of a plate which grips one of the doors or windows and a housing which abuts against the other door or window. The plate is usually toothed or perforated to be adjustably locked in the housing. Such devices are disclosed in Canadian Pat. Nos. 855, 950 and 1,156,062.

SUMMARY OF THE INVENTION

The locking device according to the invention is particularly directed to double sliding doors and adapted to hold them in their closed position. Each pair of sliding doors has an inner door surrounded by an adjacent jamb. The vertical portion of these jambs which are adjacent when the doors are closed define an orthogonal double check or zig-zag space. A set of at least two separable plates having substantially the shape of said orthogonal zig-zag space are mounted separatly in superpsed position in said space and locked together to prevent their removal from the zig-zag space. The plates prevent the sliding of the doors when they are in their closed position.

DETAILED DESCRIPTION OF THE DRAWINGS

Figure 1:
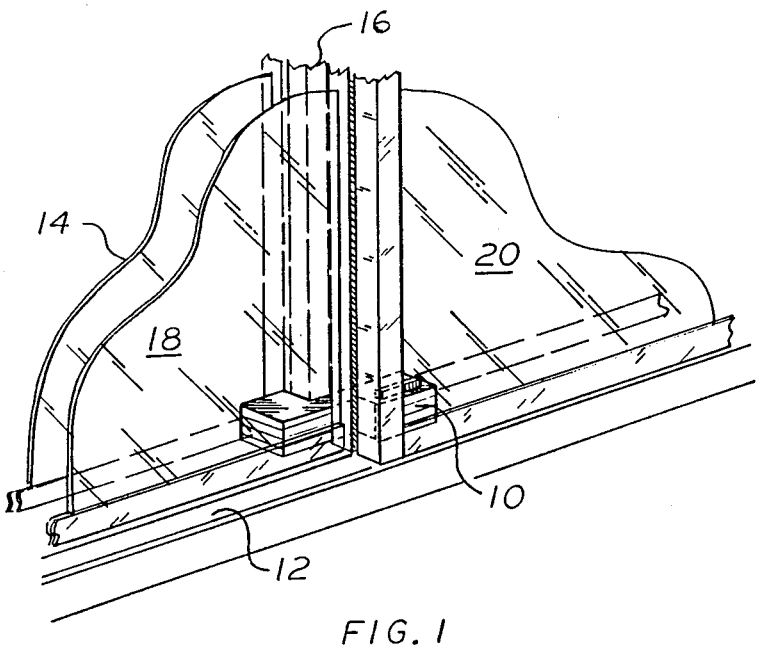
FIG. 1 is a perspective view of a double sliding door including a locking device according to the invention.

FIG. 1 illustrates the locking device 10 positioned between double sliding doors. FIG. 1 shows the lower rails 12, the lower part of the sash in which the jamb of the windows are sliding. The double sliding windows are made of a pair of exterior windows 14 and 16 and a pair of interior windows 18 and 20. The two exterior windows 14 and 16 travel in opposite directions identified by arrows A and B shown in FIG. 2 for closing and abutting their respective vertical jambs 22 and 24. Similarly, the two interior windows 18 and 20 are travelling in opposite directions shown by the arrows C and D in FIG. 2 for closing an abutting their respective vertical jambs 26 and 28. The locking device 10 according to the invention, forms an orthogonal zig-zag or double check for abutting against the opposed surface of the exterior jamb 24 and of the interior jamb 26 to prevent them from sliding away from each other. Jambs 24 and 26 will be herein after referred to as the adjacent jambs. A distance E exists between the jambs 24 and 26 and this distance E corresponds essentially to and is slightly greater than the width of the shank portion 30 of the locking device 10. Two orthogonal shoulder portions 32 and 34 extend in opposite directions at both ends of the shank 30. Such a shape is referred to as an orthogonal zig-zag or double check arrangement. The distance between the near surfaces of shoulders 36 and 38 corresponds essentially to and is slightly greater than a length F of the overlap of the jambs, and shoulders 36 and 38 are adapted to abut against the opposite sides of the adjacent jambs 24 and 26 when the latter are in their closed position.

Figure 2:
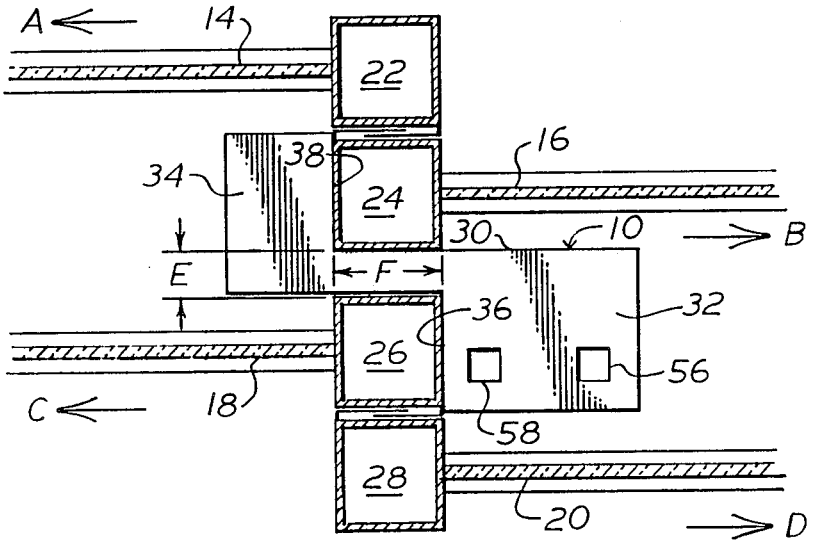
FIG. 2 is a top plan view of the lower portion of the double sliding doors locked with the new locking device.
Figure 3:
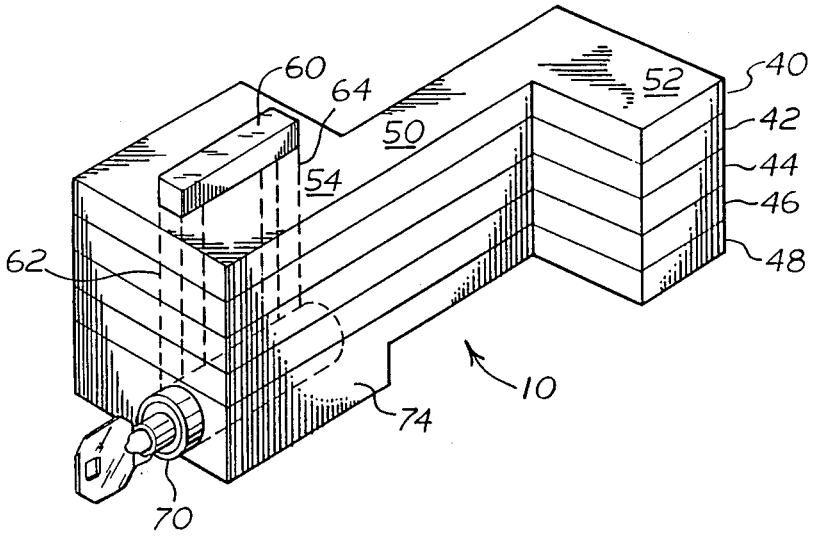
FIG. 3 is a perspective view of a locking device according to the invention.

The locking device 10 as shown in FIG. 3, is essentially made of a plurality of superposed plates 40, 42, 44, 46 and 48. Each of the plates has a lean shank 50 and tongues or shoulder portions 52 and 54 orthogonally projecting at each end in opposite directions. The shank 50 has a width as shown in FIG. 2, smaller than the distance E between the two jambs 24 and 26. The thickness of the shank 50 is also important because, as explained later in more details, each plate is introduced edgewise in the space between the jambs 24 and 26 and then rotated flatwise so that the tongues 52 and 54 will form limiting walls for the jambs 24 and 26. Each of the plates 40–48 are introduced separately between the jambs 24 and 26 and superposed flatwised.

In order to prevent the plates 40–48 from being removed in the same manner, means for fastening them together is contemplated. All the plates from 40 to 48 have a tongue provided with peforations 56 and 58 adapted to receive a U-shaped bar 60. The two legs 62 and 64 of the bar 60 are introduced through the series of superposed perforations 56 and 58 of all the plates. Only one leg such as 62 could be considered sufficient to lock all the plates together but two legs such as 62 and 64 are preferred to prevent the twisting of the plates relative to one another in the horizontal plane. At least, one of the legs is provided with a notch 66 which is located to reach the level of the lowermost plate 48. A cylindrical lock 70 having a latch 72 is secured inside the plate 48 wherein the latch 72 is adapted to project into the notch 66 of the legs 64 for preventing the removal of the br 60. Considering that the plate 48 must have a limited thickness as explained above and that the diameter of the lock 70 may be greater than the thickness of the plate 48, a small auxiliary plate 74 is secured under the plate 48 below the tongue 54 by screws 76. The combined thickness of plate 74 and 48 allows a solid retention of the lock 70 and is positioned so that the latch 72 can protract in the peforations 58 at the level of the notch 66.

In operation, when the double sliding doors are closed, plate 48 is introduced edgewise between the adjacent jambs 24 and 26 of the two inner doors 16 and 18 of both pairs of doors and rotated flatwise to sit on the rails 12 of the doorway. Subsequently and in the same manner, plates 40 to 46 are subsequently introduced and stacked one over the other. The U-shaped bar 60 is then slid into the perforations 56 and 58 and the bar 60 is locked in position by a key actuating the lock 70 which protracts the latch 72 into the notch 66. Such a locking device prevents the possibility of removing the plates when the latter are fastened together because they cannot be twisted between the two adjacent jambs.

The plates 40 to 48 may be made of wood or plastic, but metal is more reliable to prevent breakage by means of a saw. A suitable combination consists of plates 40 to 48 made of plastic with a metal core extending through the shank 50 and up to both ends of the lateral tongues 52 and 54. The bar 60 is preferably made of a solid metal such as steel.

Figure 4:
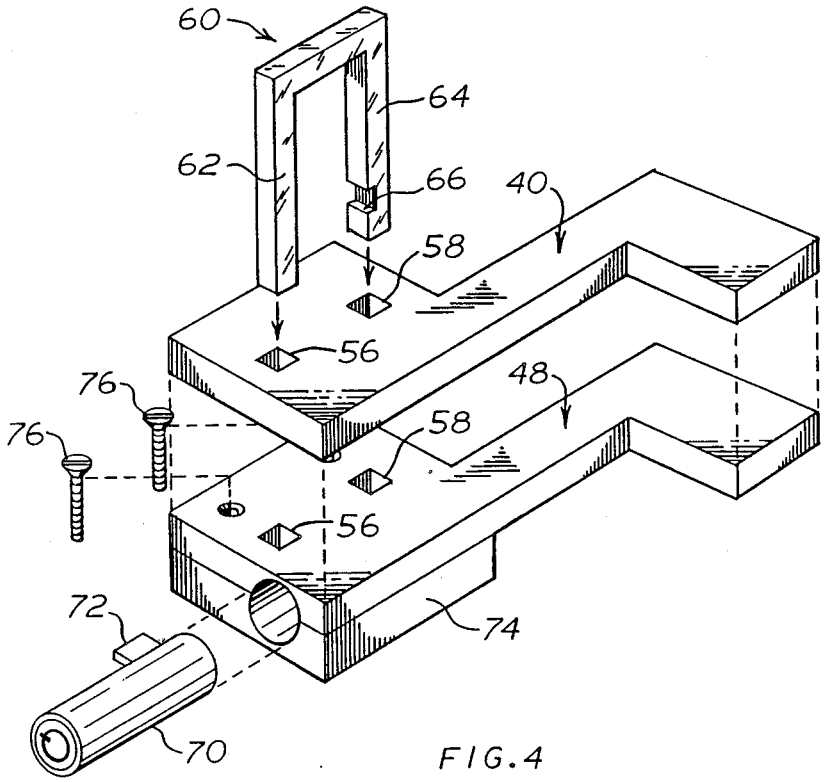
FIG. 4 is an exploded view of part of the locking device shown in FIG. 3.
Figure 5:
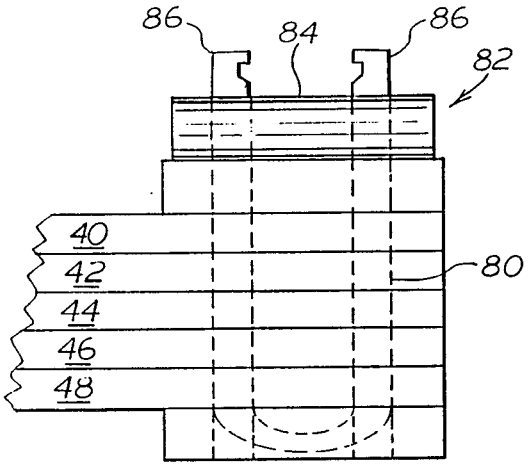
FIG. 5 is a side view of a portion of a door locking device showing an alternative means for fastening the plates together.

FIG. 5 illustrates a different embodiment for holding the plates 40–48 together. The plates are provided with a pair of circular apertures corresponding to the apertures 56 and 58 shown in FIG. 4 for receiving the U-shaped member 80 of a suitable padlock 82. Each of the plates 40–48 are introduced sidewise between the adjacent jambs of doors 16 and 18 shown in FIG. 2, and introduced separately and sequentially on the U-shaped member 80 which has been previously positioned to receive the plates. The lock member 84 is subsequently mounted over the free and of the U-shaped member 80 to secure itself on the serrated surfaces 86 of the U-shaped member 80. The locking member 84 may be pushed downwardly until the plates 40–48 are tightly held together. The padlock of the type illustrated in FIG. 5 is conventionaly known as bicycle or motorcycle lock and sold by companies such as Master Lock in United States or Viro in Italy.

Figure 6:
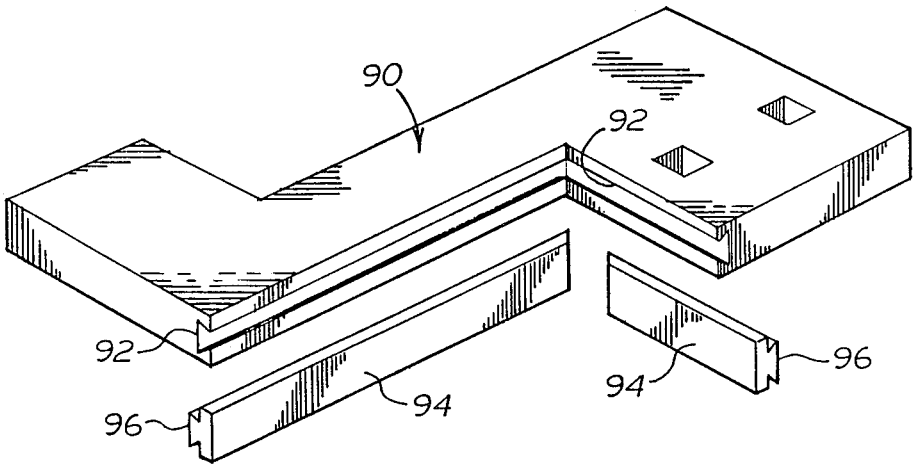
FIG. 6 is an exploded view of one of the plates with thickening blades and, FIG. 7 is a side view of a pin fastening the plates.

Considering that all the double sliding windows do not have the same dimensional specifications and accordingly the same space between the adjacent jambs, the locking device 10 is made with optimum dimensions so that each plate can be introduced edgewise and that all the plates when tightened together cannot be removed from their locking position. One embodiment includes a shank width of about ½ inch and a distance between the tongues of about 2½ inches. The locking device 10 can also be supplied with a variety of dimensions so as to comply with the specifications of various types of double sliding doors. However, it is contemplated to supply a set of plates with a shank having a width corresponding to a minimum distance and having a length corresponding to a maximum length, wherein the width can be increased and the length of the shank can be decreased. Such an embdiment is illustrated in FIG. 6 wherein a plate 90 for the purpose explained above is provided with a mortise edge 92 on two right angular faces of the plate. A thickening blade 94 having a tenon part 96 is provided to engage into the mortise 92. The addition of the thickening blades 94 onto orthogonal sides of the plate will increase the thickness of the shank and shorten its length. Such thickening blades 94 are made with various thicknesses so as to change the dimensions of the shank according to the specifications of the double sliding door. It is also contemplated to provide thickening blades such as 94 with its flat side provided with a mortise so that more than one thickening blade can be superposed one over the other.

Although the above description includes a plurality of plates in the locking device, it should be understood that two superposed plates could be sufficient if each one can be introduced edgewise between the sliding windows and can be prevented from being removed therefrom when fastened together.

Figure 7:
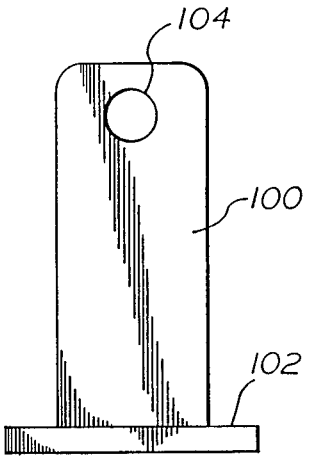

The plates 40–48 can also be fastened together by using only one pin such as illustrated in FIG. 7. The pin 100 projects through the apertures provided in all the superposed plates. The pin 100 has an enlarged base 102 on which all the plates are resting and is provided with an aperture 104 at the other end for receiving a commonly known padlock and accordingly safely securing all the plates on the pin 100. The height of the aperture 104 is adjusted to correspond to the number of plates required to be fastened together and according to the specifications of the double sliding door.

I claim:

1. A device for locking adjacent sliding doors of double sliding doors in their closed position, each adjacent sliding door being provided with a jamb spaced from each other by a distance (E), said jambs overlapping over a length (F) to define a double check space when said adjacent doors are closed; said device comprising a set of at least two superposed and separable plates, each plate having a thickness smaller than said distance (E) to allow each plate to be individually slid edgewise and subsequently disposed flatwise, each of said plates having a shank portion and a pair of opposite tongue portions orthogonally extending sideways in opposite directions at each end of the shank and substantially corresponding to said double check space, whereby one of said tongues has a contoured surface adapted to abut against one of said jambs and the other of said tongues has a contoured surface adapted to abut against the other of said jambs to prevent the sliding of said adjacent doors, and locking means adapted to extend through said plates while superposed and disposed flatwise for preventing the edgewise rotation of said plates.

2. A device as recited in claim 1, wherein the width of said shank between said tongues is slightly smaller than said distance (E) and the distance between the contoured abutment surfaces of the tongues is slightly greater than said length (F).

3. A device as recited in claim 1, wherein said means for locking said plates comprises at least one rod adapted to slide through aligned perforations provided in each plate and means on said rod for retaining said plates in adjacent relationship on said rod.

4. A device as recited in claim 3, wherein said retaining means comprises a key operated padlock for gripping said rod.

5. A device as recited in claim 3, wherein said perforations are provided through one of said opposite tongues of each of said plates.

6. A device as recited in claim 1, wherein said plates have a linear core made of metal, said core extending through said shank and said tongues of each of said plates.

7. A device as recited in claim 1, wherein the width of each of said shanks is about ½ inch and the distance between the two tongues of each of said plates is about 2½ inches.

8. A device as recited in claim 1, wherein the shank and tongues of each of said plates are provided with keyways on their lateral surfaces adapted to receive thickening blades for increasing the width of said shank of each of said plates and decreasing the distance between said contoured abutment surfaces of said tongues of each of said plates.

9. A device as recited in claim 8, wherein said blades and said lateral surfaces are provided with mortise joints.

* * * * *